US010139191B1

(12) United States Patent
Kempf et al.

(10) Patent No.: US 10,139,191 B1
(45) Date of Patent: Nov. 27, 2018

(54) SHOOTING BOW WITH REDUCED LIMB TRAVEL

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 15/897,292

(22) Filed: Feb. 15, 2018

Related U.S. Application Data

(62) Division of application No. 15/463,503, filed on Mar. 20, 2017, now Pat. No. 10,018,442.

(60) Provisional application No. 62/312,535, filed on Mar. 24, 2016.

(51) Int. Cl.
*F41B 5/10* (2006.01)
*F41B 5/12* (2006.01)

(52) U.S. Cl.
CPC ..... *F41B 5/123* (2013.01); *F41B 5/10* (2013.01)

(58) Field of Classification Search
CPC ..... F41B 5/10; F41B 5/123
See application file for complete search history.

(56) References Cited

U.S. PATENT DOCUMENTS 3,809,048 A * 5/1974 Handford ..... F41A 1/02 124/25
3,990,425 A * 11/1976 Ketchum ..... F41B 5/10 124/25.6
4,457,288 A * 7/1984 Ricord ..... F41B 5/10 124/25.6
4,512,326 A * 4/1985 Jarrett ..... F41B 5/10 124/25.6
4,649,891 A * 3/1987 Bozek ..... F41B 5/123 124/25
4,722,317 A * 2/1988 Hartwig ..... F41B 5/10 124/25.6
4,766,874 A * 8/1988 Nishioka ..... F41B 5/12 124/25
4,879,987 A * 11/1989 Nishioka ..... F41B 5/123 124/25
4,917,071 A * 4/1990 Bozek ..... F41B 5/12 124/24.1
5,630,405 A * 5/1997 Nizov ..... F41B 5/123 124/25

(Continued)

*Primary Examiner* — John Ricci
(74) *Attorney, Agent, or Firm* — Donald J. Ersler

(57) ABSTRACT

An extreme reverse style crossbow, a reverse style crossbow or a reverse style crossbow with a single stirrup includes two cams, one string, two pulleys and two cables. The pulleys are rotatably retained on the limbs, adjacent the two cams. A dual stirrup crossbow includes two cams, one string, two pulleys and one cable. The two pulleys are rotatably retained on two cam axles. A second dual stirrup crossbow includes two cams, one string, two pulleys and two cables. The two pulleys are rotatably retained on two cam axles. A non-conventional crossbow includes two cams, one string, two pulleys and one cable. The two cams are rotatably retained on limbs between the proximal and distal ends thereof. The two pulleys are rotatably retained on two cam axles. A vertical bow includes two cams, one string, two pulleys and one cable. The two pulleys are rotatably retained on two cam axles.

6 Claims, 11 Drawing Sheets

(56) References Cited

U.S. PATENT DOCUMENTS 5,678,528 A * 10/1997 Hadley ..... F41B 5/12 124/24.1
6,776,148 B1 * 8/2004 Islas ..... F41B 5/10 124/25.6
6,792,931 B1 * 9/2004 Schaar ..... F41B 5/10 124/25.6
7,047,958 B1 * 5/2006 Colley ..... F41B 5/10 124/25.6
7,328,693 B2 * 2/2008 Kempf ..... F41B 5/123 124/25
7,578,289 B2 * 8/2009 Norkus ..... F41B 5/0094 124/25
7,624,724 B2 * 12/2009 Bednar ..... F41B 5/123 124/25
7,637,256 B2 * 12/2009 Lee ..... F41B 5/105 124/25.6
7,823,572 B2 * 11/2010 Anderson ..... F41B 5/123 124/25
7,891,348 B2 * 2/2011 Colley ..... F41B 5/123 124/25
7,938,108 B2 * 5/2011 Popov ..... F41B 5/123 124/25
8,387,603 B2 * 3/2013 Darlington ..... F41B 5/10 124/23.1
8,627,811 B1 * 1/2014 Darlington ..... F41B 5/1426 124/25
8,651,095 B2 * 2/2014 Islas ..... F41B 5/105 124/25
8,826,894 B1 * 9/2014 Darlington ..... F41B 5/105 124/25
8,899,217 B2 * 12/2014 Islas ..... F41B 5/105 124/25.6
8,919,332 B2 * 12/2014 Trpkovski ..... F41B 5/0094 124/23.1
8,997,728 B2 * 4/2015 Popov ..... F41B 5/0094 124/25.6
9,243,861 B1 1/2016 Kempf et al.
2005/0279338 A1 * 12/2005 Dziekan ..... F41B 5/12 124/25
2008/0060629 A1 * 3/2008 Chang ..... F41B 5/123 124/25
2008/0251058 A1 * 10/2008 Colley ..... F41B 5/105 124/25
2009/0101126 A1 * 4/2009 Anderson ..... F41B 5/123 124/25
2010/0154762 A1 * 6/2010 Darlington ..... F41B 5/10 124/25
2011/0041820 A1 * 2/2011 Stanziale ..... F41B 5/105 124/25
2011/0056467 A1 * 3/2011 Popov ..... F41B 5/0094 124/25.6
2012/0125302 A1 * 5/2012 Stanziale ..... F41B 5/123 124/25
2014/0261360 A1 * 9/2014 Pulkrabek ..... F41B 5/1469 124/35.2
2015/0285581 A1 * 10/2015 Chang ..... F41B 5/123 124/25

* cited by examiner

SHOOTING BOW WITH REDUCED LIMB TRAVEL

CROSS-REFERENCES TO RELATED APPLICATIONS

This is a divisional patent application of patent application Ser. No. 15/463,503 filed on Mar. 20, 2017, which claims the benefit of provisional application No. 62/312,535 filed on Mar. 24, 2016.

BACKGROUND OF THE INVENTION

Field of the Invention

The present invention relates generally to archery and more specifically to a shooting bow with reduced limb travel, which reduces the amount of limb flex, without reducing power stroke of the bow.

Discussion of the Prior Art

The present invention deals with archery shooting bows and crossbows (bows) with cams (also called string guides), and more specifically to the cable and string configuration utilized on the bows. The cable configuration of the present invention has many benefits over prior art. In a prior art twin cam bow, the first limb flexs proportionally to the amount of cable that has wrapped on the first cable cam, less the distance the second limb moves towards the first limb. In order to allow for less limb flex, binary style cams were developed, which allowed for cable "pay out" where the cable unwraps from a portion of the cams. This prior art required the complexity of payout to be integrated into the cam itself, and this restricted the cams rotational amount, often to less than 200 degrees. The pulley bow (Kempf-Isenhower) allowed for some amount of cable payout not associated to the cams, but still limited the amount of payout, and did not reduce the amount of limb flex.

Another drawback to the pulley bow was that the cams were no longer synchronized to one another. The present invention configuration allows for synchronization, self-timing, more cable payout, less limb flex, greater cam rotation, and greater efficiency. The present invention may use one string, which propels the arrow, and the use of one or more cables. A bow limb (bow with "solid limbs"), or a set of limbs (bow with "split limbs"), typically has a proximal end, which is generally coupled to a frame, and a distal end. The cams are usually located on the distal end. Occasionally, the cams may be located between proximal and distal ends. The cable and string configuration may be used on any design of bow, including but not limited to: vertical bows with the string coming off the rear of the cam; vertical bows having the string come off the front of the cam; crossbows with rear facing (standard) limb configuration where the string comes off the rear of the cam; crossbows with rear facing (standard) limb configuration where the string comes off the front of the cam; crossbows with forward facing (reverse draw style) limb configuration where the string comes off the front of the cam; crossbows with forward facing (reverse draw style) limb configuration where the string comes off the rear of the cam; crossbows where the cams are coupled to the limbs at a location between the distal and proximal portions of the limbs, and the string comes off the front side of the cams; and crossbows where the cams are coupled to the limbs at a location between the distal and proximal portions of the limbs, and the string comes off the front side of the cams.

In a crossbow, the crossbow frame may be made of multiple components, such as a riser, barrel, limb pockets, foot stirrup, and assembled using fasteners and the like, or the frame may be made in one piece, wherein the components or some of the components may be molded or formed as one unit.

Accordingly, there is a clearly felt need in the art for a reduced limb travel bow, which reduces the amount of limb flex, without reducing power stroke of the bow.

SUMMARY OF THE INVENTION

The present invention provides a shooting bow with reduced limb travel, which reduces the amount of limb flex, without reducing power stroke of the bow. An extreme reverse style crossbow includes two cams, one string, two pulleys and two cables. The pulleys are rotatably retained in the limbs adjacent the two pulleys. A reverse style crossbow includes two cams, one string, two pulleys and two cables. The pulleys are rotatably retained in the limbs adjacent the two pulleys. A reverse style crossbow with a stirrup includes two cams, one string, two pulleys and two cables. The pulleys are rotatably retained in the limbs adjacent the two pulleys. A dual stirrup crossbow includes two cams, one string, two pulleys and one cable. The two pulleys are rotatably retained on two cam axles. A second dual stirrup crossbow includes two cams, one string, two pulleys and two cables. The two pulleys are rotatably retained on two cam axles. A non-conventional crossbow includes two cams, one string, two pulleys and one cable. The two cams are rotatably retained on limbs between the proximal and distal ends thereof. The two pulleys are rotatably retained on two cam axles. A vertical bow includes two cams, one string, two pulleys and one cable. The two pulleys are rotatably retained on two cam axles.

Accordingly, it is an object of the present invention to provide a reduced limb travel bow, which reduces the amount of limb flex, without reducing power stroke of the bow.

These and additional objects, advantages, features and benefits of the present invention will become apparent from the following specification.

DETAILED DESCRIPTION OF THE PREFERRED EMBODIMENTS

Figure 1:
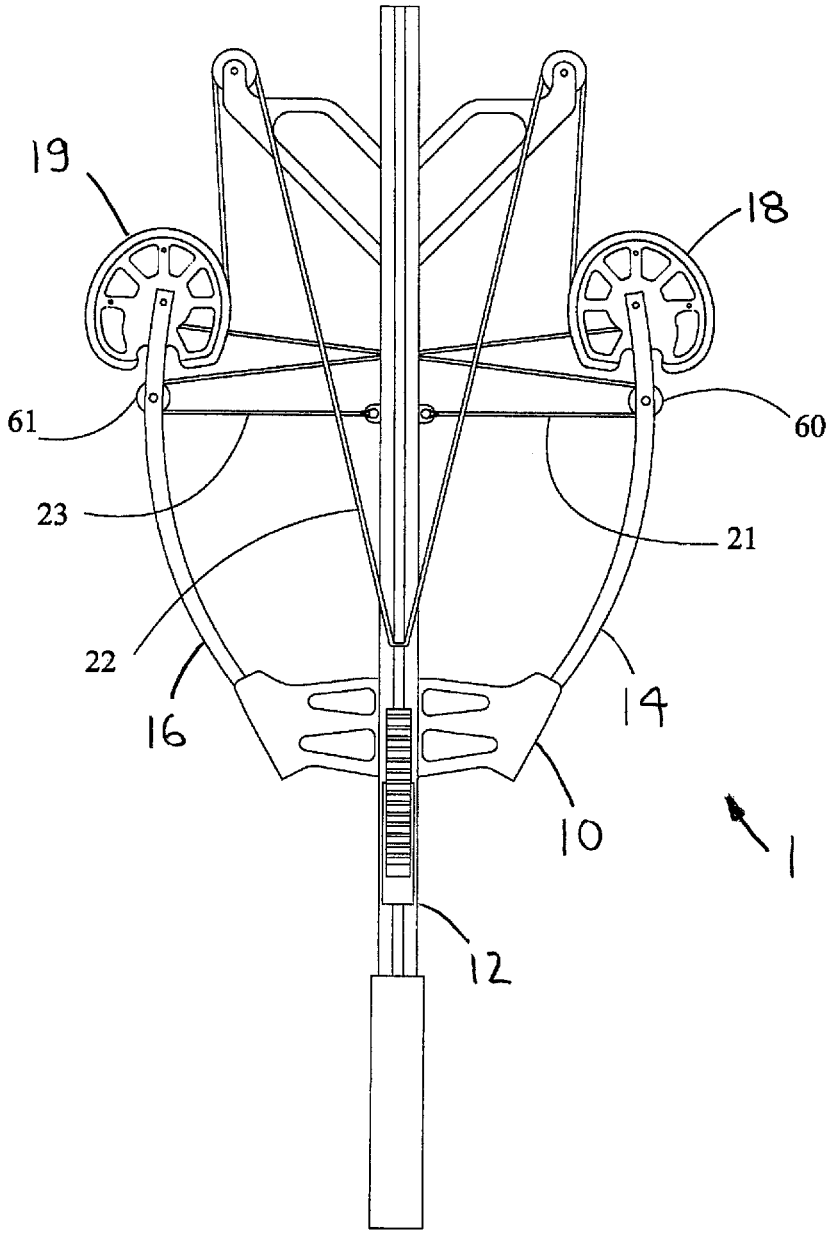
FIG. 1 is a top view of an extreme reverse style crossbow with one string and two cables in accordance with the present invention.

With reference now to the drawings, and particularly to FIG. 1, there is shown a top view of an extreme reverse style crossbow 1. The extreme reverse style crossbow 1 preferably includes a riser 10, a barrel 12, a first limb 14, a second limb 16, a first cam 18, a second cam 19, a first cable 21, a bow string 22 and a second cable 23. The riser 10 is attached to the barrel 12. One end of the first limb 14 is attached to a first end of the riser 10 and one end of the second limb 16 is attached to a second end of the riser 10. The first cam 18 is rotatably retained on an opposing end of the first limb 14 and the second cam 19 is rotatably retained on an opposing end of the second limb 16. A first pulley 60 is rotatably retained on the first limb 14, adjacent the first cam 18. A second pulley 61 is rotatably retained on the second limb 16, adjacent the second cam 19. A first end of the bow string 22 is retained on the first cam 18 and a second end of the bow string 22 is retained on the second cam 19. One end of the first cable 21 is retained on the second cam 19; wrapped on the first pulley 60 and an opposing end is secured to a first side of the barrel 12. One end of a second cable 23 is retained on the first cam 18; wrapped on the second pulley 61 and an opposing end is secured to a second side of the barrel 12.

Figure 2:
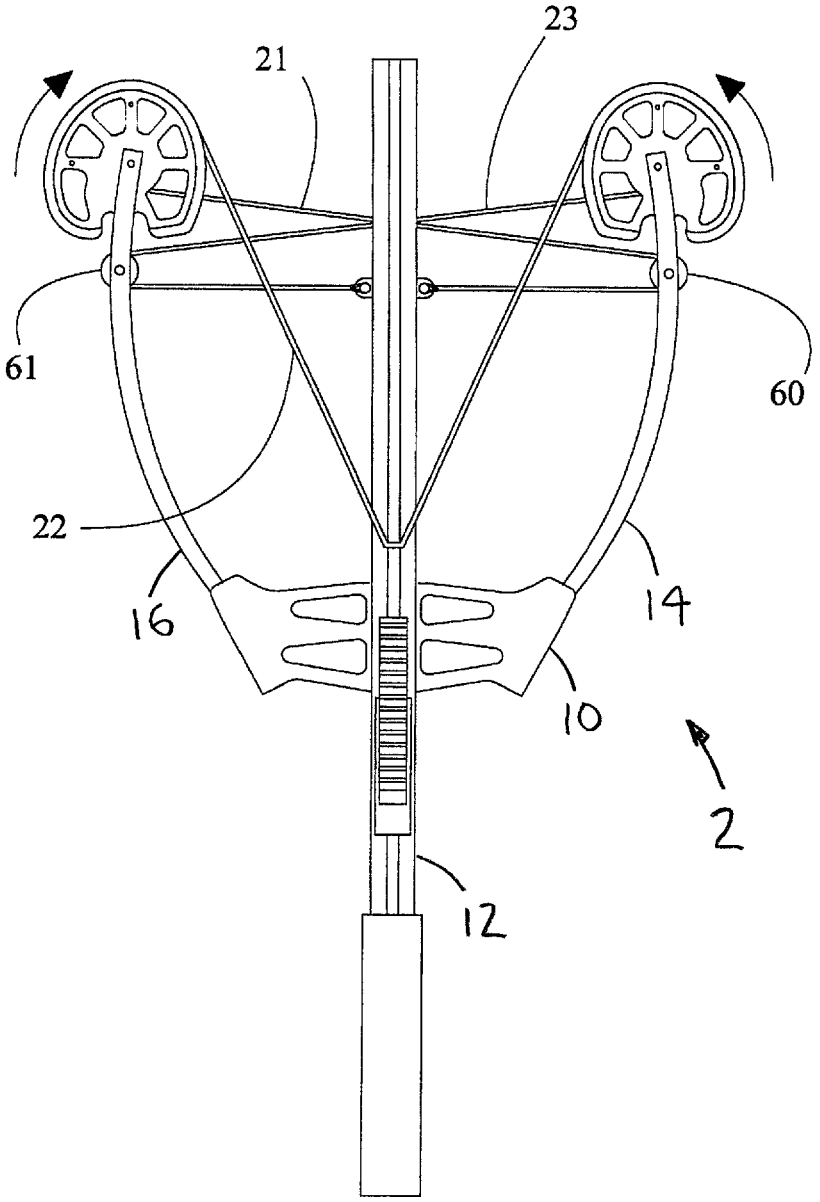
FIG. 2 is a top view of a reverse style crossbow with a string coming off a front of a cam, in a partially drawn position, the reverse draw style crossbow having one string and two cables in accordance with the present invention.

With reference to FIG. 2, a reverse style crossbow 2 preferably includes the riser 10, the barrel 12, the first limb 14, the second limb 16, the first cam 18, the second cam 19, the first cable 21, the bow string 22 and the second cable 23. The riser 10 is attached to the barrel 12. One end of the first limb 14 is attached to the first end of the riser 10 and one end of the second limb 16 is attached to the second end of the riser 10. The first cam 18 is rotatably retained on an opposing end of the first limb 14 and the second cam 19 is rotatably retained on an opposing end of the second limb 16. The first pulley 60 is rotatably retained on the first limb 14, adjacent the first cam 18. The second pulley 61 is rotatably retained on the second limb 16, adjacent the second cam 19. The first end of the bow string 22 is retained on the first cam 18 and the second end of the bow string 22 is retained on the second cam 19. One end of the first cable 21 is retained on the second cam 19; wrapped on the first pulley 60 and an opposing end is secured to a first side of the barrel 12. One end of the second cable 23 is retained on the first cam 18; wrapped on the second pulley 61 and then opposing end is secured to a second side of the barrel 12.

Figure 3:
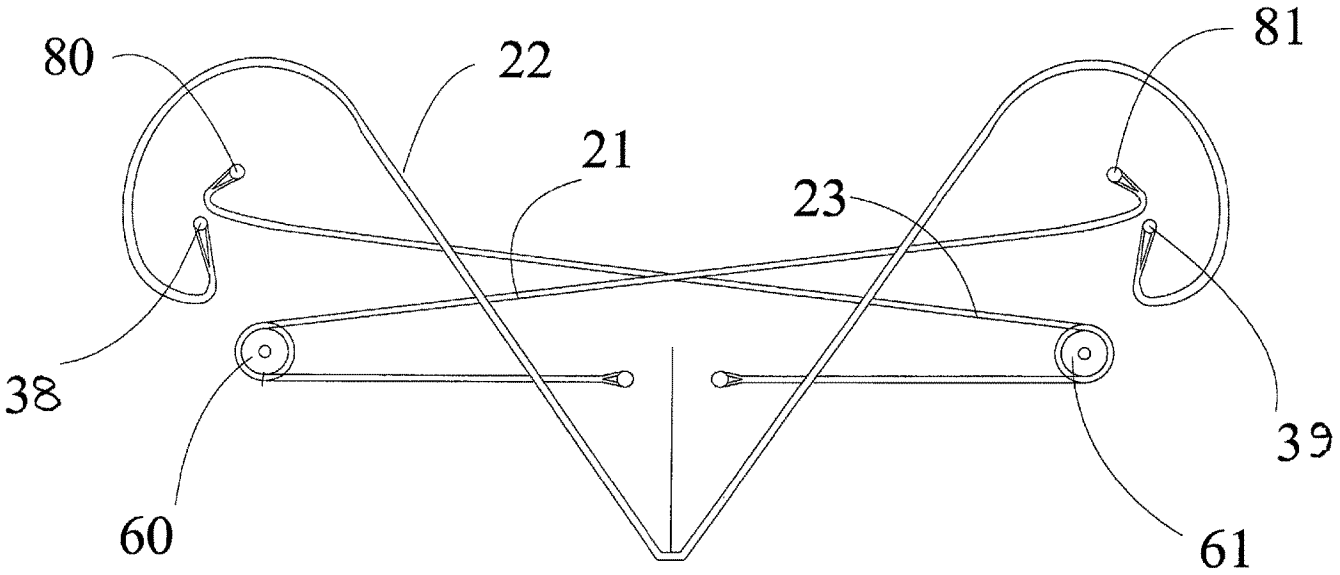
FIG. 3 is a bottom view of a string and cable configuration of a reverse style crossbow where pulleys would be rotatably retained in the limbs, and would have one string and two cables in accordance with the present invention.
Figure 4:
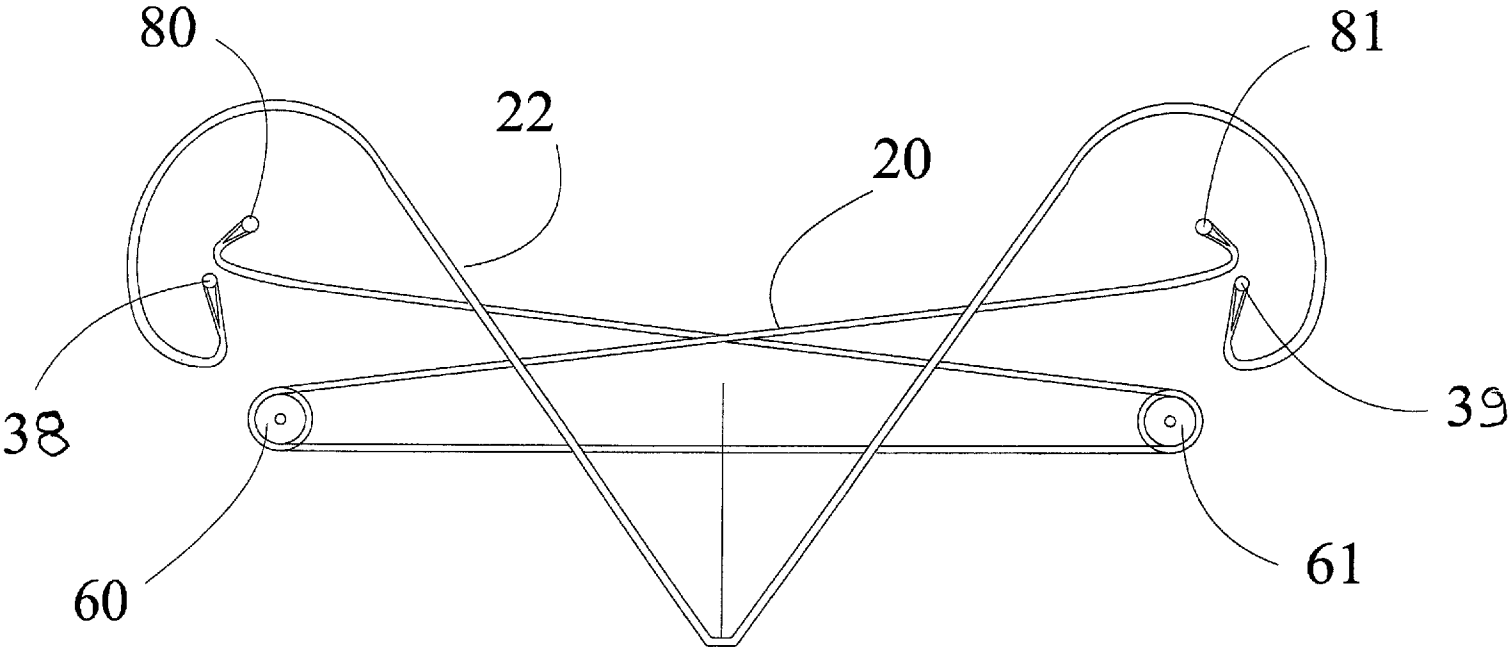
FIG. 4 is a bottom view of a string and configuration of a bow where pulleys are coupled to cams, and a bow would have one string and one cable in accordance with the present invention.

With reference to FIG. 3, the first end of the bow string 22 is anchored to a first cam post 38 and the second end of the bow string 22 is anchored to a second cam post 39. One end of the first cable 21 is anchored to a second cam post 81; wrapped around the first pulley 60 and an opposing end anchored to a first side of the barrel 12 (not shown). One end of the second cable 23 is anchored to a first cam post 80; wrapped around the second pulley 61 and an opposing end anchored to a second side of the barrel 12. With reference to FIG. 4, the first end of the bow string 22 is anchored to a first cam post 38 and the second end of the bow string 22 is anchored to a second cam post 39. One end of a single cable 20 is anchored to a first cam post 80; wrapped around the second pulley 61; wrapped around the first pulley 60; and an opposing end is anchored to a second cam post 81.

Figure 5:
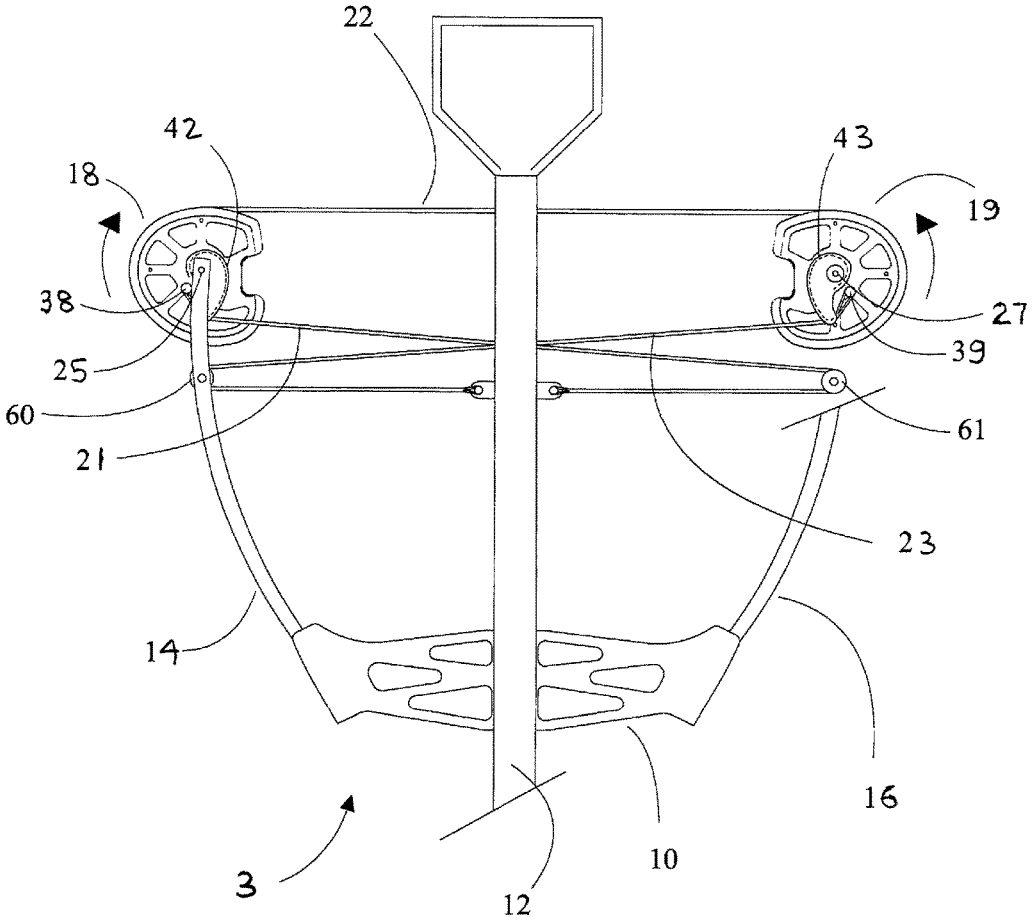
FIG. 5 is a bottom view of a reverse style crossbow with a single stirrup, one string and two cables in accordance with the present invention.

With reference to FIG. 5, a reverse style crossbow 3 preferably includes a riser 10, a barrel 12, a first limb 14, a second limb 16, a first cam 18, a second cam 19, a first cable 21, a bow string 22 and a second cable 23. The riser 10 is attached to the barrel 12. One end of the first limb 14 is attached to a first end of the riser 10 and one end of the second limb 16 is attached to a second end of the riser 10. The first cam 18 is rotatably retained on an opposing end of the first limb 14 and the second cam 19 is rotatably retained on an opposing end of the second limb 16. A first pulley 60 is rotatably retained on the first limb 14, adjacent the first cam 18. A second pulley 61 is rotatably retained on the second limb 16, adjacent the second cam 19. A first end of the bow string 22 is retained on the first cam 18 and a second end of the bow string 22 is retained on the second cam 19. One end of the first cable 21 is retained on the first cam post 38; wrapped on the second pulley 61 and an opposing end is secured to a second side of the barrel 12. One end of the second cable 23 is retained on the second cam post 39; wrapped on the first pulley 60 and an opposing end is secured to a first side of the barrel 12.

Figure 6:
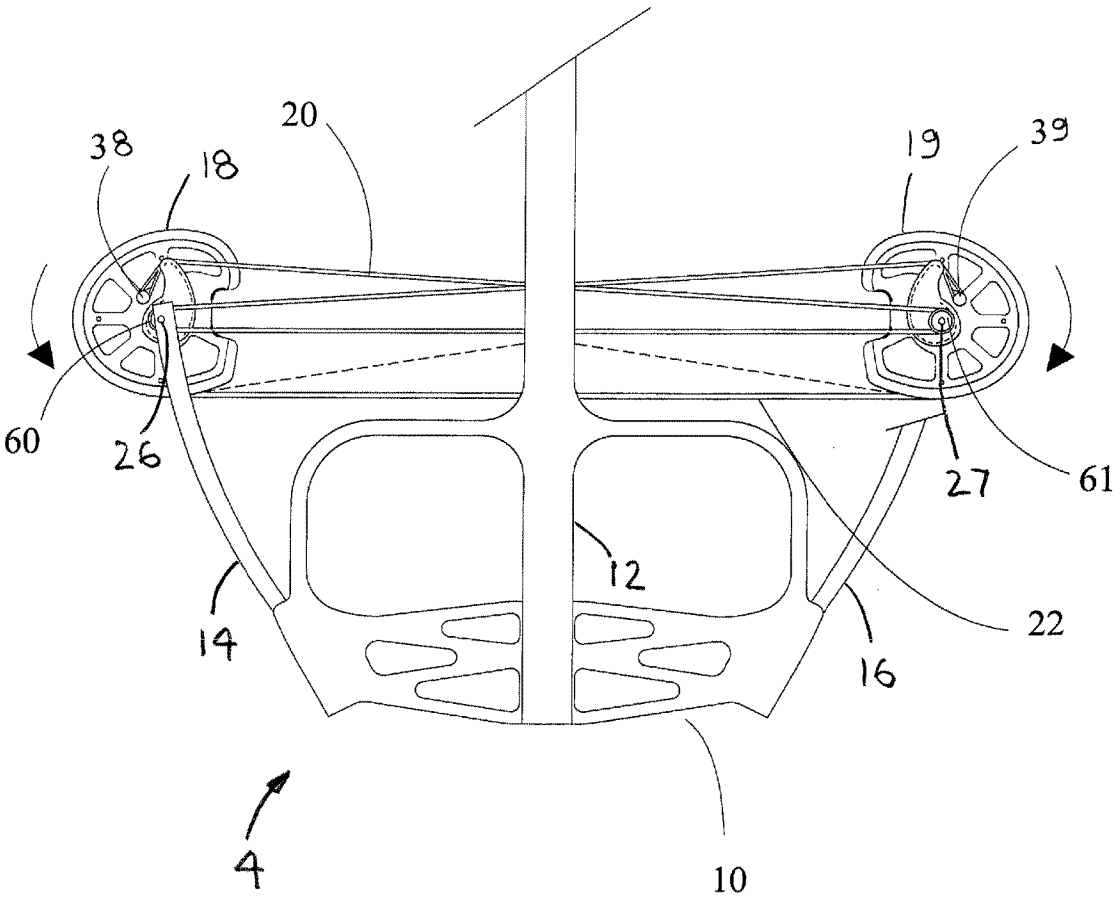
FIG. 6 is a bottom view of a dual stirrup crossbow with strings coming off a front of the cams, where the dual stirrup crossbow has one string and one cable in accordance with the present invention.

With reference to FIG. 6, a dual stirrup crossbow 4 preferably includes the riser 10, the barrel 12, the first limb 14, the second limb 16, the first cam 18, the second cam 19, the single cable 20 and the bow string 22. The riser 10 is attached to the barrel 12. One end of the first limb 14 is attached to a first end of the riser 10 and one end of the second limb 16 is attached to a second end of the riser 10. The first cam 18 is rotatably retained on an opposing end of the first limb 14 and the second cam 19 is rotatably retained on an opposing end of the second limb 16. The first pulley 60 is rotatably retained on a first cam axle 26. The second pulley 61 is rotatably retained on a second cam axle 27. A first end of the bow string 22 is retained on the first cam 18 and a second end of the bow string 22 is retained on the second cam 19. A first end of the single cable 20 is anchored to the first cam post 38; wraps around the second pulley 61; wraps around the first pulley 60; and a second end of the single cable 20 is anchored to the second cam post 39.

Figure 7:
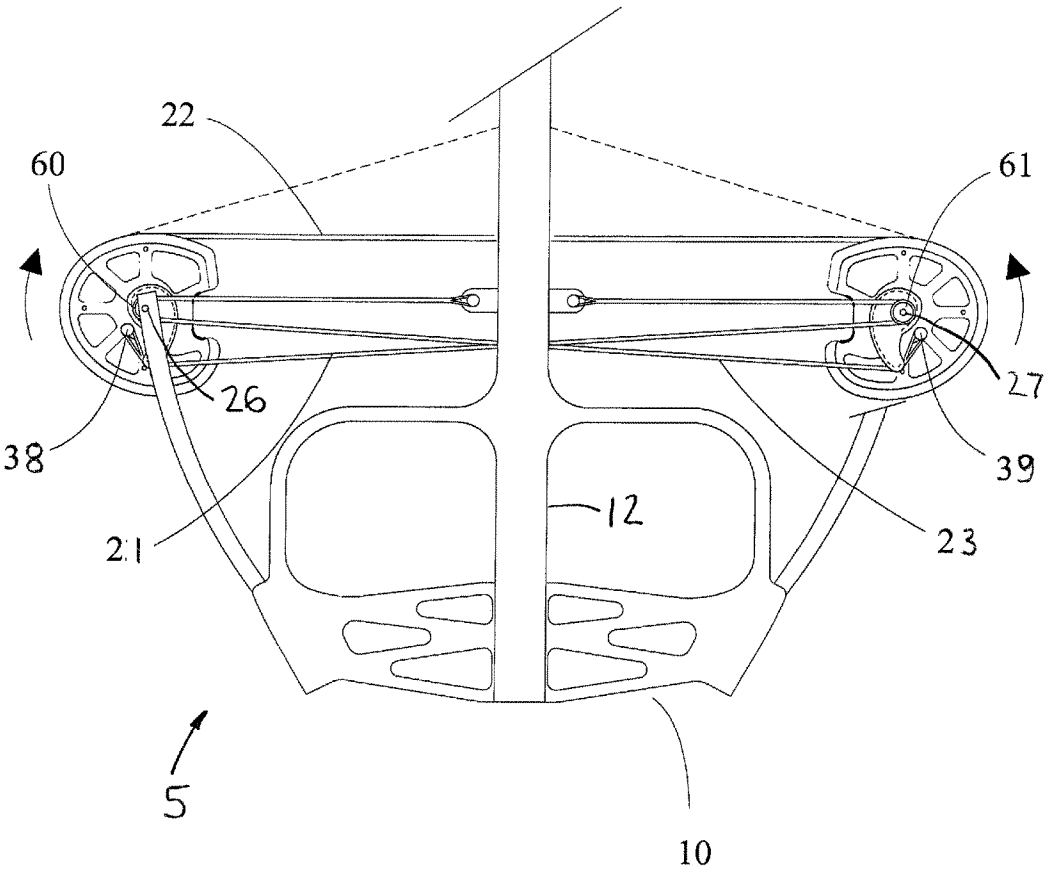
FIG. 7 is a bottom view of a dual stirrup crossbow with a string coming off a back of a cam, where the dual stirrup crossbow has one string and two cables in accordance with the present invention.

With reference to FIG. 7, a dual stirrup crossbow 5 preferably includes the riser 10, the barrel 12, the first limb 14, the second limb 16, the first cam 18, the second cam 19, the first cable 21, the bow string 22 and the second cable 23. The riser 10 is attached to the barrel 12. One end of the first limb 14 is attached to a first end of the riser 10 and one end of the second limb 16 is attached to a second end of the riser 10. The first cam 18 is rotatably retained on an opposing end of the first limb 14 and the second cam 19 is rotatably retained on an opposing end of the second limb 16. The first pulley 60 is rotatably retained on a first cam axle 26. The second pulley 61 is rotatably retained on a second cam axle 27. One end of the first cable 21 is retained on the first string cam post 38; wrapped on the second pulley 61 and an opposing end is secured to a first side of the barrel 12. One end of the second cable 23 is retained on the second cam post 39; wrapped on the first pulley 60 and an opposing end is secured to a second side of the barrel 12. A first end of the bow string 22 is retained on the first cam 18 and a second end of the bow string 22 is retained on the second cam 19.

Figure 8:
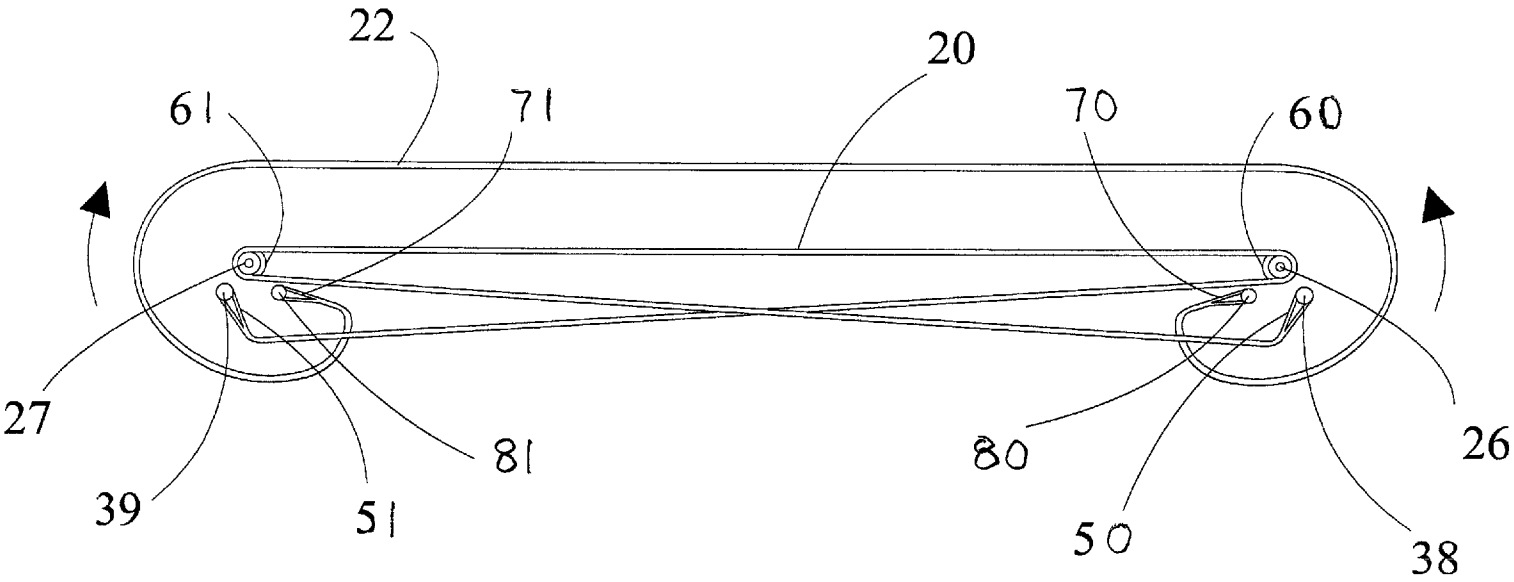
FIG. 8 is a top view of a string and cable configuration of a bow where pulleys would be rotatably retained on cam axles, and the bow would have one string and one cables of the present invention.
Figure 9:
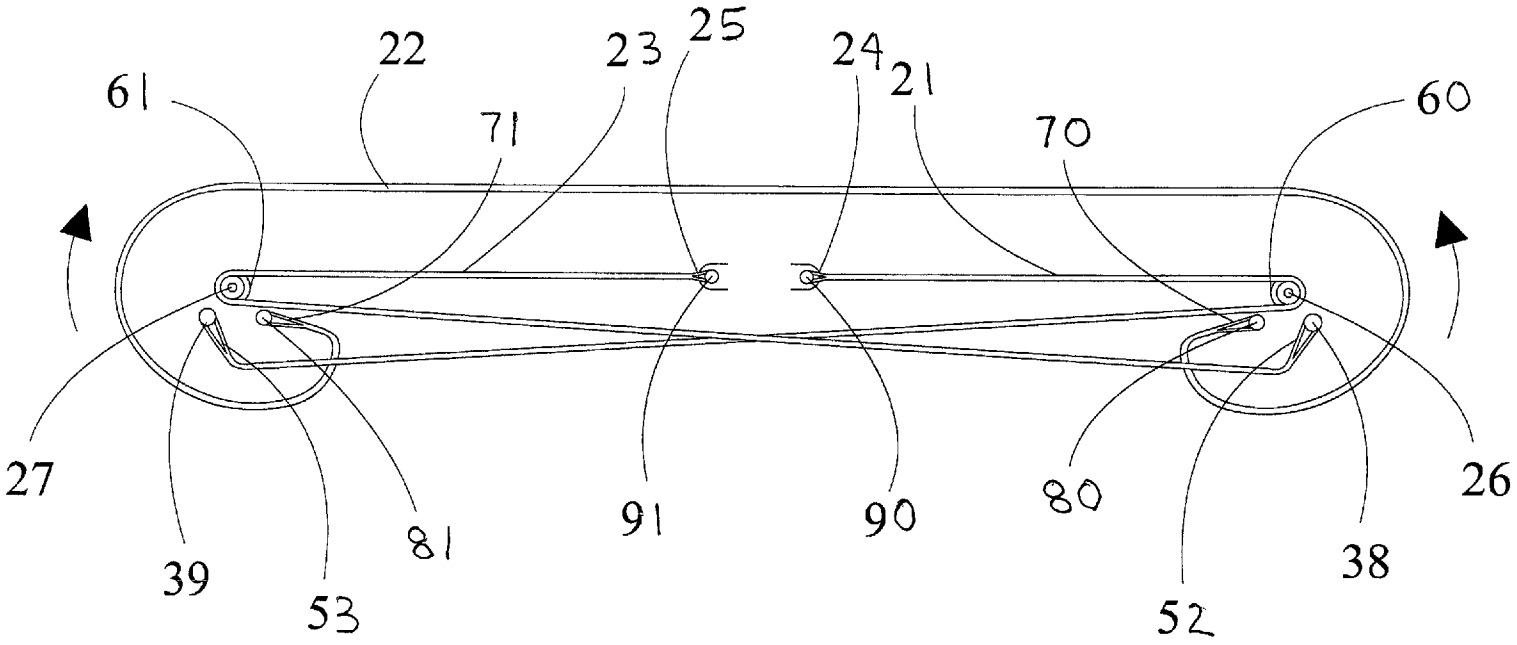
FIG. 9 is a top view of a string and cable configuration of a bow where pulleys would be rotatably retained on cam axles, and the bow would have one string and two cables in accordance with the present invention.

With reference FIG. 8, the first end of the bow string 22 is anchored to the first cam post 80 with a first loop 70 and the second end of the bow string 22 is anchored to the second cam post 81 with a second loop 71. One end of the single cable 20 is anchored to the first cam post 38 with a first loop 50; wrapped around the second pulley 61; wrapped around the first pulley 60; and an opposing end is anchored to the second cam post 39 with a second loop 51. With reference to FIG. 9, the first end of the bow string 22 is anchored to the first cam post 80 with the first loop 70 and the second end of the bow string 22 is anchored to the second cam post 81 with the second loop 71. One end of the first cable 21 is anchored to the second cam post 39 with a first loop 52; wrapped around the first pulley 60 and an opposing end anchored to a first barrel post 90 with a first cable loop 24. One end of the second cable 23 is anchored to a first cam post 38 with a second cable loop 53; wrapped around the second pulley 61 and an opposing end anchored to a second barrel post 91 with a second cable loop 25.

Figure 10:
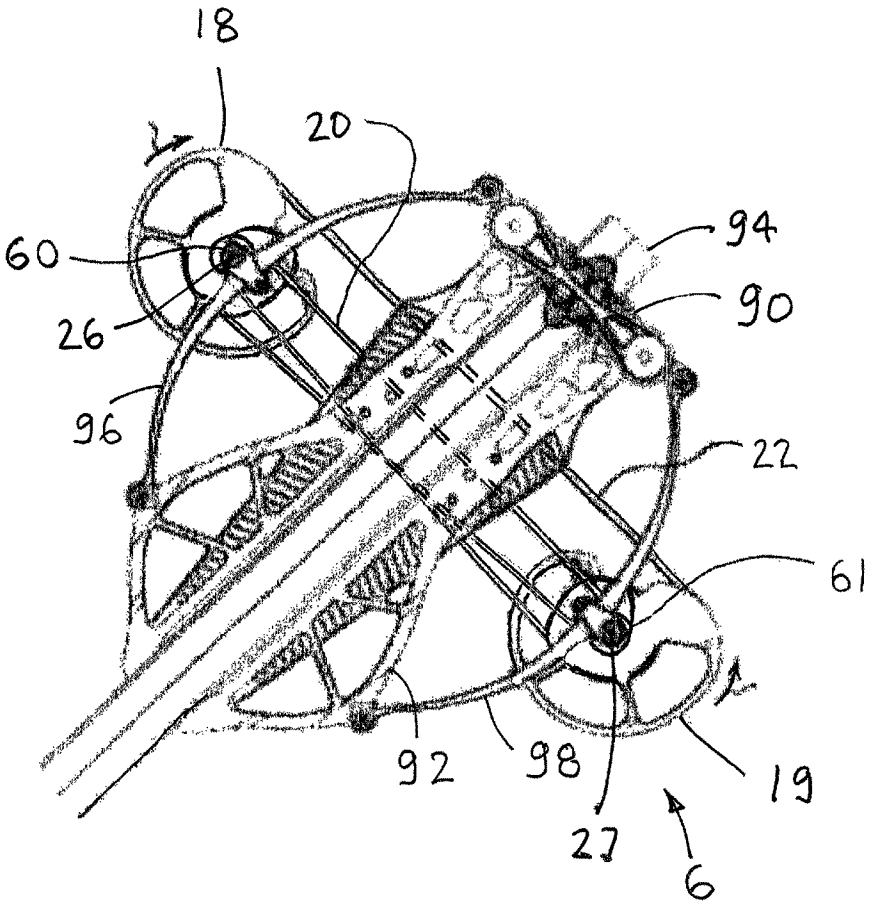
FIG. 10 is a bottom view of a non-conventional crossbow with cams rotatably retained on limbs between proximal and distal ends thereof; the bow utilizing one string and one cable; and pulleys rotatably retained on cam axles in accordance with the present invention.

With reference to FIG. 10, a crossbow with non-conventional cam placement 6 preferably includes a first riser 90, a second riser 92, a barrel 94, a first limb 96, a second limb 98, the first cam 18, the second cam 19, the single cable 20 and the bow string 22. The first riser 90 is attached to one end of the barrel 94. The second riser 92 is attached to substantially a midpoint of the barrel 94. A first end of the first limb 96 is secured to a first side of the first riser 90 and a second end of the first limb 96 is secured to a first end of the second riser 92. A first end of the second limb 98 is secured to a second side of the first riser 90 and a second end of the second limb 98 is secured to a second end of the second riser 92. The first cam 18 is rotatably retained on substantially a midpoint of the first limb 96. The second cam 19 is rotatably retained on substantially a midpoint of the second limb 98. The first pulley 60 is rotatably retained on the first cam axle 26. The second pulley 61 is rotatably retained on the second cam axle 27. A first end of the bowstring 22 is retained on the first cam 18 and a second end of the bowstring 22 is retained on the second cam 19. One end of the single cable 20 is anchored to the first cam 18; wrapped around the second pulley 61; wrapped around the first pulley 60; and an opposing end is anchored to the second cam 19.

Figure 11:
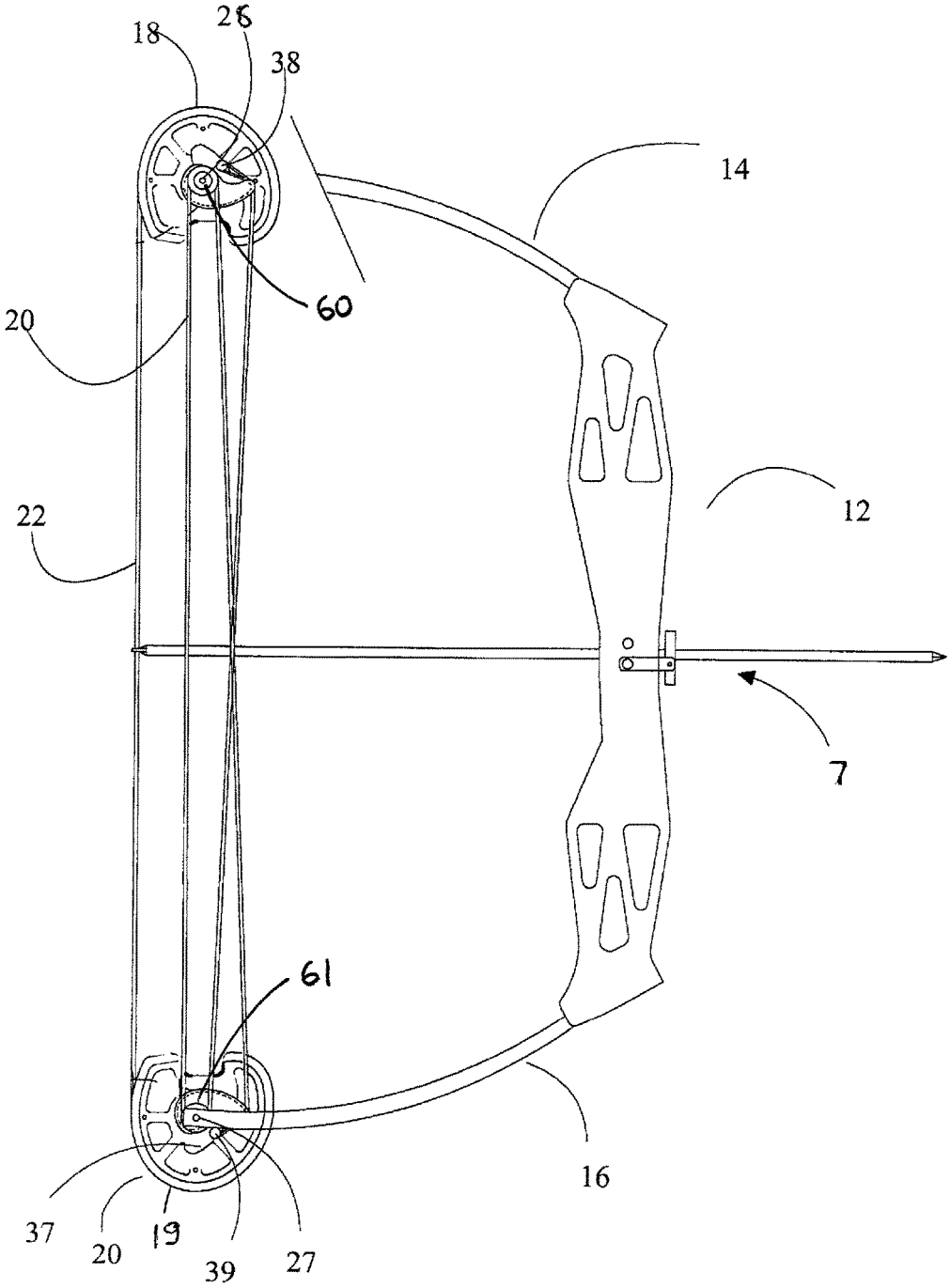
FIG. 11 is a side view of a vertical bow having pulleys rotatably retained on cam axles and the vertical bow includes one string and one cable in accordance with the present invention.

With reference to FIG. 11, a vertical bow 7 preferably includes the riser 10, the first limb 14, the second limb 16, the first cam 18, the second cam 19, the single cable 20 and the bow string 22. One end of the first limb 14 is attached to a first end of the riser 10 and one end of the second limb 16 is attached to a second end of the riser 10. The first cam 18 is rotatably retained on an opposing end of the first limb 14 and the second cam 19 is rotatably retained on an opposing end of the second limb 16. The first pulley 60 is rotatably retained on a first cam axle 26. The second pulley 61 is rotatably retained on a second cam axle 27. A first end of the bow string 22 is retained on the first cam 18 and a second end of the bow string 22 is retained on the second cam 19. A first end of a single cable 20 is anchored to the first cam post 38; wraps around the second pulley 61; wraps around the first pulley 60; and a second end of the single cable 20 is anchored to the second cam post 39.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A shooting bow comprising:

a riser;

a first limb having one end attached to a first side of said riser;

a second limb having one end attached to a second side of said riser;

a first cam rotatably retained on said first limb with a first axle;

a second cam rotatably retained on said second limb with a second axle;

a first pulley is rotatably retained on said first axle;

a second pulley is rotatably retained on said second axle;

a cable having one end attached to a first cam, retained on said second pulley, retained on said first pulley and an opposing end attached to said second cam; and a bowstring having a first end attached to said first cam, a second end of said bowstring is attached to said second cam.

2. The shooting bow of claim 1, further comprising:

said riser is attached to a barrel.

3. The shooting bow of claim 1 wherein:

said first cam is located on an opposing end of said first limb, said second cam is located on an opposing end of said second limb.

4. The shooting bow of claim 1 wherein:

said shooting bow is a reverse style crossbow.

5. The shooting bow of claim 1 wherein:

said shooting bow is a reverse style crossbow with a stirrup.

6. The shooting bow of claim 1 wherein:

said first cam is located at substantially a mid-point of said first limb, said second cam is located at substantially a mid-point of said second limb.

* * * * *